US008226433B1

(12) United States Patent
Correll et al.

(10) Patent No.: US 8,226,433 B1
(45) Date of Patent: Jul. 24, 2012

(54) LATCH ASSEMBLY FOR MOUNTING POWER SUPPLY BASE FOR A PROCESS FIELDBUS ON A DIN RAIL AND METHOD

(75) Inventors: Michael Anthony Correll, Hershey, PA (US); Terry Lee Barber, Harrisburg, PA (US)

(73) Assignee: Phoenix Contact Development & Manufacturing, Inc., Middleton, PA (US)

( * ) Notice: Subject to any disclaimer, the term of this patent is extended or adjusted under 35 U.S.C. 154(b) by 0 days.

(21) Appl. No.: 13/069,644

(22) Filed: Mar. 23, 2011

(51) Int. Cl.
*H01R 13/60* (2006.01)
*H01R 13/66* (2006.01)

(52) U.S. Cl. ..... 439/532

(58) Field of Classification Search ..... 439/110, 439/532, 716, 717
See application file for complete search history.

(56) References Cited

U.S. PATENT DOCUMENTS

| | | | | |
|---|---|---|---|---|
| 6,292,076 | B1 | 9/2001 | DeGrazia et al. | |
| 7,674,129 | B1 | 3/2010 | Liu | |
| 7,758,368 | B2 * | 7/2010 | Schelonka et al. | 439/325 |
| 2008/0108248 | A1 | 5/2008 | Lim et al. | |
| 2009/0286422 | A1 | 11/2009 | Henkel et al. | |
| 2010/0134986 | A1 | 6/2010 | Hecht et al. | |

* cited by examiner

*Primary Examiner* — Javaid Nasri
(74) *Attorney, Agent, or Firm* — Hooker & Habib, P.C.

(57) ABSTRACT

A base for mounting on a DIN rail includes a body and a latch assembly on the bottom of the body. The latch assembly has an elongate actuator extending to one side of the base and a latch member attached to the actuator for engaging the DIN rail. The release member is held on the base in an assembly position to facilitate mounting of the attachment member on the release member and the base, and is then shifted to an operative position.

19 Claims, 9 Drawing Sheets

LATCH ASSEMBLY FOR MOUNTING POWER SUPPLY BASE FOR A PROCESS FIELDBUS ON A DIN RAIL AND METHOD

FIELD OF THE INVENTION

The invention relates to latch assemblies for removably mounting a base, typically a power supply base, on a DIN rail, and to methods for forming a base with a DIN rail latch assembly.

BACKGROUND OF THE INVENTION

Electronic bases are conventionally removably latched on DIN rails or other mounting members. Each base typically includes a pair of hollow shells which house electronic components. The components have exposed contact members for forming electrical connections with the other electronic components outside the base. The base is assembled by placing the electronic components in the shells and then securing the shells together.

A latch for securing the base on a DIN rail or other mounting element is typically mounted on the shells when the shells are joined together. Properly positioning the parts of the latch in the shells during assembly can be difficult. Improper location of the parts during assembly of the shells increases the difficulty and cost of manufacturing bases.

BRIEF DESCRIPTION OF THE INVENTION

The invention is an improved power supply base with a latch assembly for latching and removing the base on a DIN rail or other mounting member and a method for mounting the latch assembly on the base.

Manufacture of the base is facilitated by positively positioning part of the latch assembly in a fixed initial assembly position in the shells, completing mounting of the latch assembly and then shifting the assembly from the initial position to an operative position.

The latch assembly includes a release member, a latch member and a spring for biasing the assembly toward a latched position. The release member is joined to the latch member to facilitate shifting the latch member away from the DIN rail for unlatching.

During assembly of the base or module, the release member is secured to the shells forming the base in a known initial or assembly position and the latch member is then inserted into the bottom of the shells to form a physical connection with the positioned release member. The joined release member and latch member are then moved toward the rail to an operative position to free the release member from the base and permit free movement between latched and retracted positions. The spring is inserted into the latch assembly to bias the latch assembly toward the latched position.

Positive location of the release member in the shells during assembly assures that the release member is in a known initial assembly position for receiving and forming a physical connection with the latch member. Shifting of the joined members toward the DIN rail frees the release member for operative movement of the assembly between latched and unlatched positions.

DESCRIPTION OF THE PREFERRED EMBODIMENT

Figure 1:
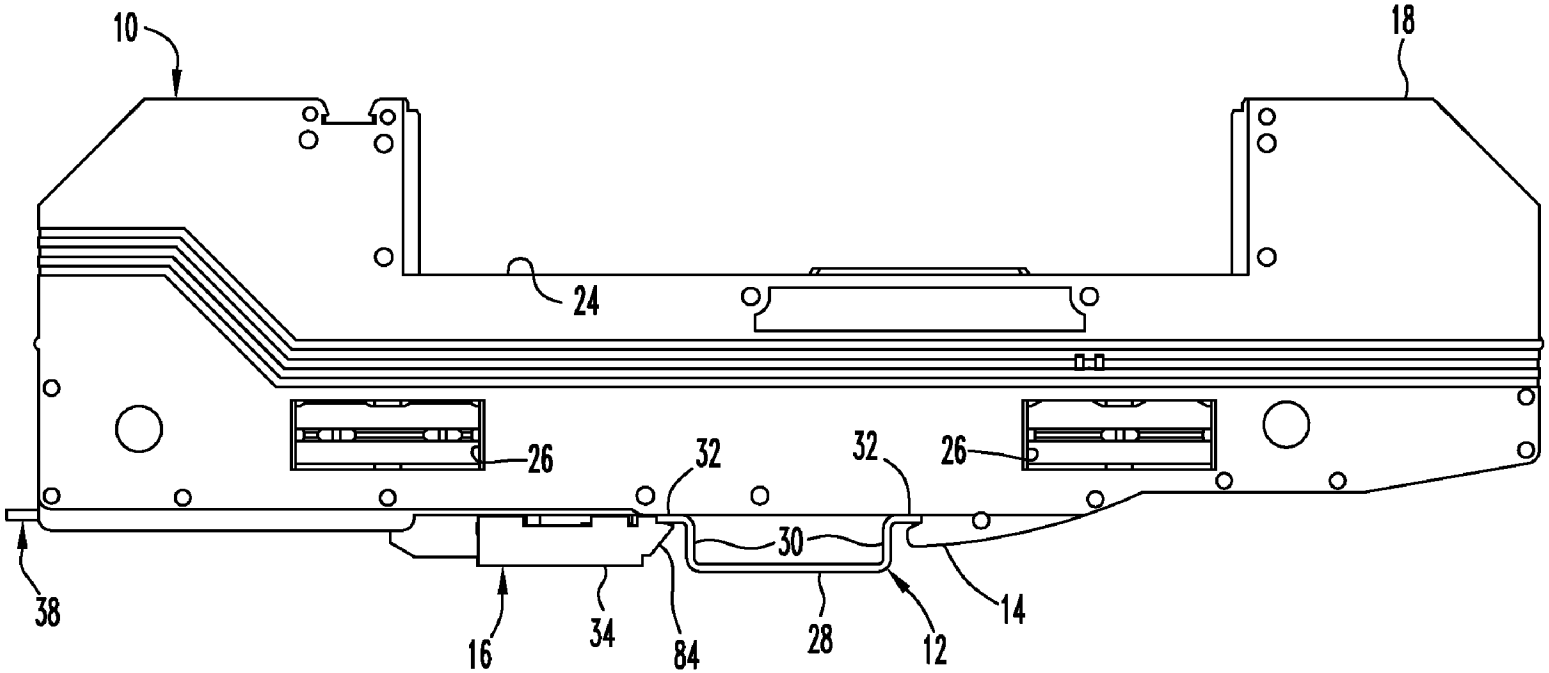
FIG. 1 is a side view of a base mounted on a DIN rail.
Figure 2:
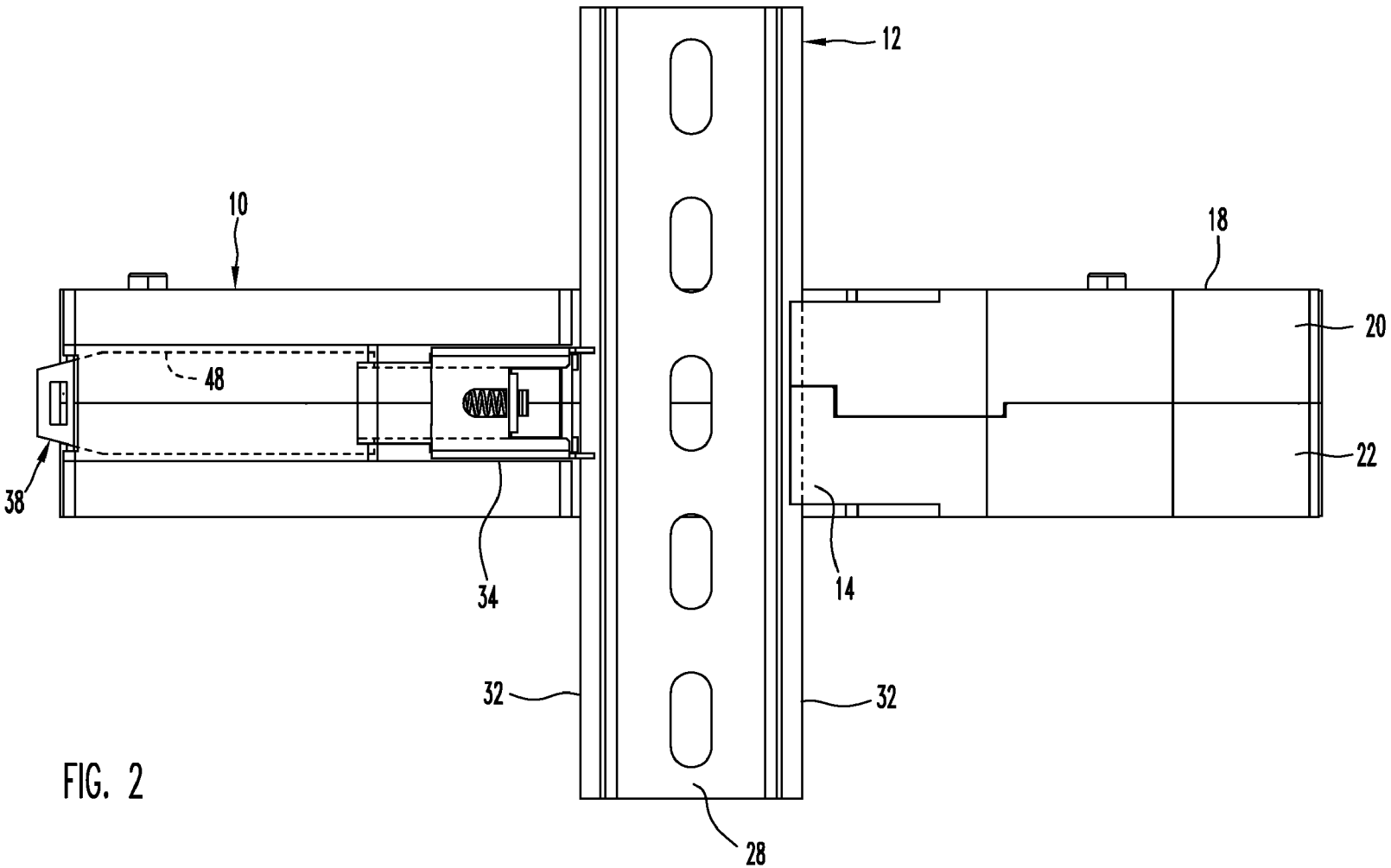
FIG. 2 is a bottom view of FIG. 1.

Power supply base 10 is removably mounted on elongate DIN rail or support 12 by DIN rail hook 14 on the bottom of the base and DIN rail latch assembly 16 on the bottom of the base on the opposite side of the rail from hook 14. The base 10 includes a hollow plastic body 18 formed from two hollow shells 20 and 22 joined together at an interface between the shells. The latch assembly extends between a DIN rail location at rail 12 and an actuation location at base end 54.

Module recess 24 is formed at the top of the base 10. A power conditioning module may be mounted in recess 24 for electrical connection with electronic components in the base, conductors in a process fieldbus connected to the base and a DC power source for the process fieldbus. The process fieldbus conductors and power supply conductors are connected to contact members on the base (not illustrated). Other types of electronic modules may be mounted in recess 24.

A power conditioning module mounted on base 10 regulates the voltage of the DC power supplied to the process fieldbus independent of the voltage of the power supplied to the module from a DC power source. The components in the base may include a circuit board assembly for connecting to the process fieldbus, the power conditioning module and the DC power source (not illustrated).

A number of bases 10 are conventionally stacked together side-by-side and are mounted on DIN rail 12. Bridging connectors (not illustrated) extend through connector openings 26 formed in the opposite sides of base 10 to establish electrical connection between components in adjacent bases.

DIN rail 12 includes an elongate, flat base 28 which is typically mounted on a support surface, side walls 30 extending upwardly from base 28 and outwardly extending mounting flanges 32 at the tops of the side walls.

DIN rail latch assembly 16 includes a metal latch member 34 mounted on the bottom of body 18 adjacent one side of rail 12. The latch member 34 is freely movable toward and away from the DIN rail when assembly 16 is operative. Spring 36 biases the latch member toward the DIN rail to engage the adjacent mounting flange 32. Assembly 16 also includes a flat, elongate release member 38 which is mounted on the bottom of body 18 and is connected to the latch member. When the latch assembly is in the operative position shown in FIGS. 1-4, it is movable toward and away from rail 12. Member 38 is pulled outwardly from the base to release the latch member 34 from the rail for removal of the base from the rail.

Release member 38 is positioned in a stepped horizontal groove 40 formed the bottom of body 18 to one side of rail 12. The groove 40 has a downwardly facing surface which extends along the seam between the shells and includes a wide outer portion 42 extending from base end 54 to groove step 44 and a narrow, inner portion 46 extending from step 44 to an inner end 47 adjacent the DIN rail. Step 44 extends outwardly to either side of narrow groove portion 46.

Release member 38 is formed from metal strip stock and includes flat body 39 having a wide portion 48 located in wide groove portion 42 and a narrow portion 50 located in narrow groove portion 46. The wide portion 48 of release member 38 provides greater strength and stability for the outer end 52 of the member which is engaged to shift the assembly 16. The inner end of the release member is narrow in order to engage narrow latch member 34. Tapered outer end 52 of release member 38 extends outwardly from adjacent base end 54 at the actuation location. Engagement opening 56 is provided in actuator end 52 of release member 38 to facilitate outward shifting of assembly 16 using a tool to release the base from the DIN rail. The release member 38 includes inwardly extending shoulders 58 between the wide and narrow portions 48 and 50.

A pair of spaced apart mounting or attachment fingers 60 extend down from the inner end of narrow strip portion 50. Center mounting finger 62 is located between fingers 60 a short distance beyond fingers 60. Fingers 60 and 62 extend down from portion 50 and are bent back toward portion 50 at an angle of 88°, shown as angle X in FIG. 9. Mounting arm 78 extends up from base 70 and is bent forward of the base 70 at an angle of 92°. The two nominal angles are supplementary. The interengagement between the angled or raked fingers 60 and 62 and angled or raked arm 78 forms a locked connection between the fingers and arm to prevent disengagement of the release and latch members when outer end 52 of member 38 is pulled to move latch member 34 and unlatch the base from the DIN rail.

Figure 3:
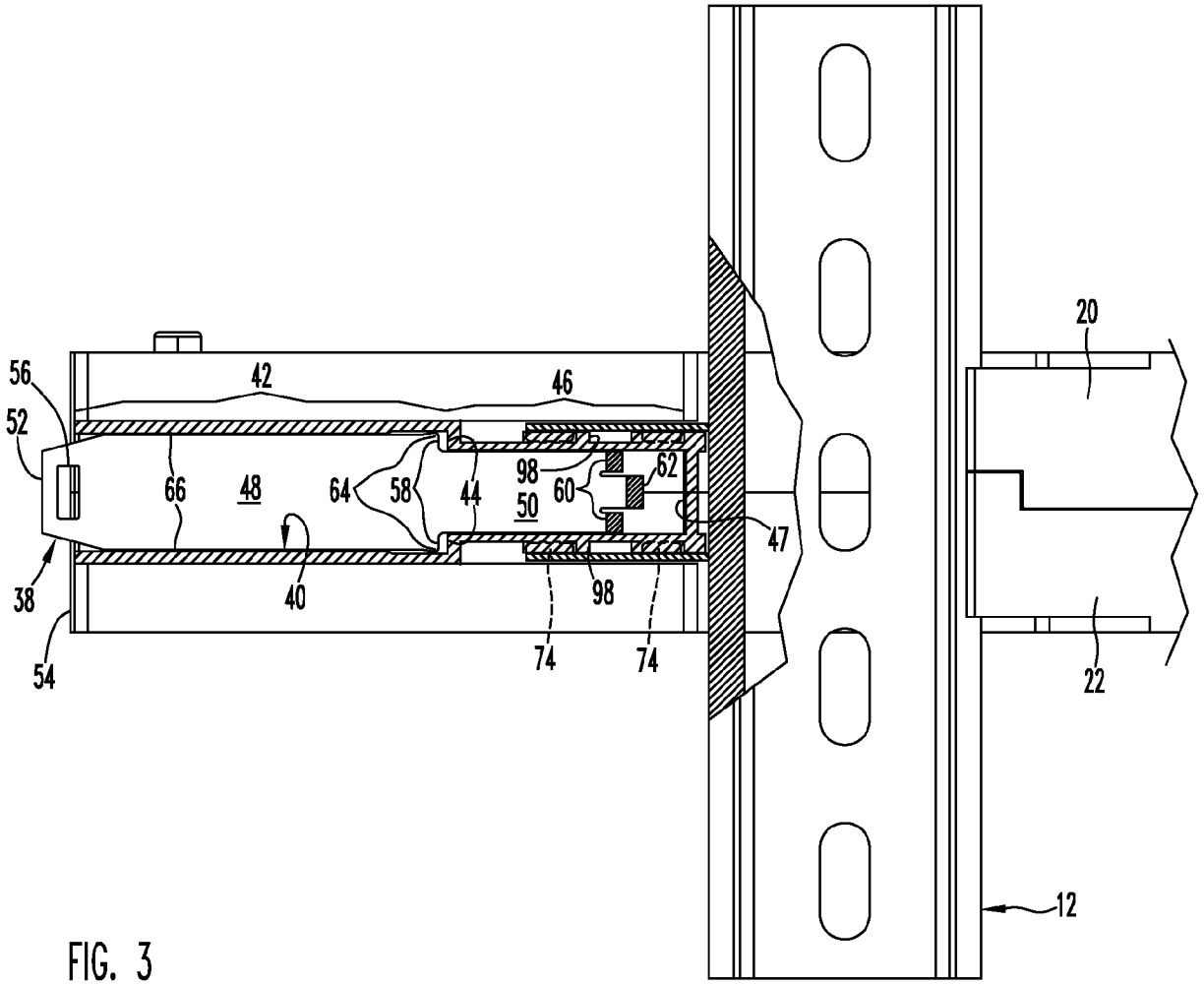
FIG. 3 is a view like FIG. 2, partially broken away.
Figure 4:
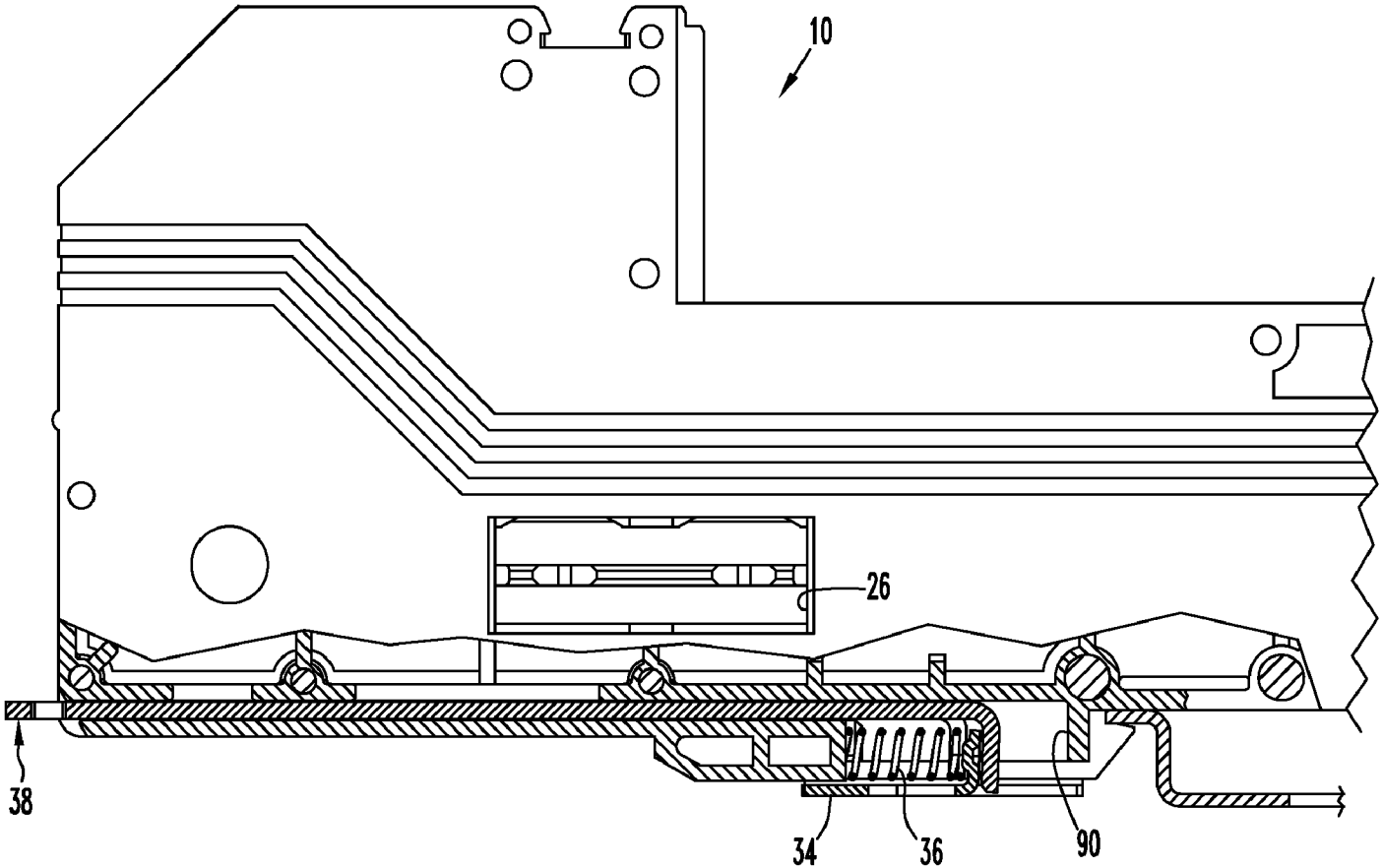
FIG. 4 is an enlarged view of a portion of FIG. 1, partially broken away.
Figure 9:
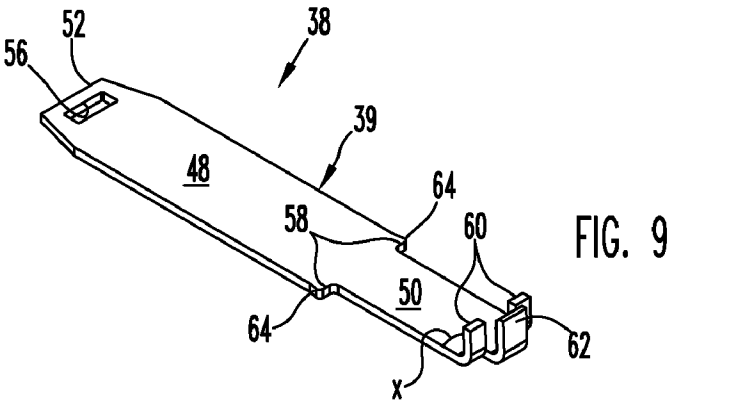
FIG. 9 is a perspective view of the release member.

As illustrated best in FIGS. 3 and 9, projections 64 at the inner end of wide release member portion 48 extend a short distance outwardly from the opposed, parallel sides of portion 48 at shoulders 58.

Figure 6:
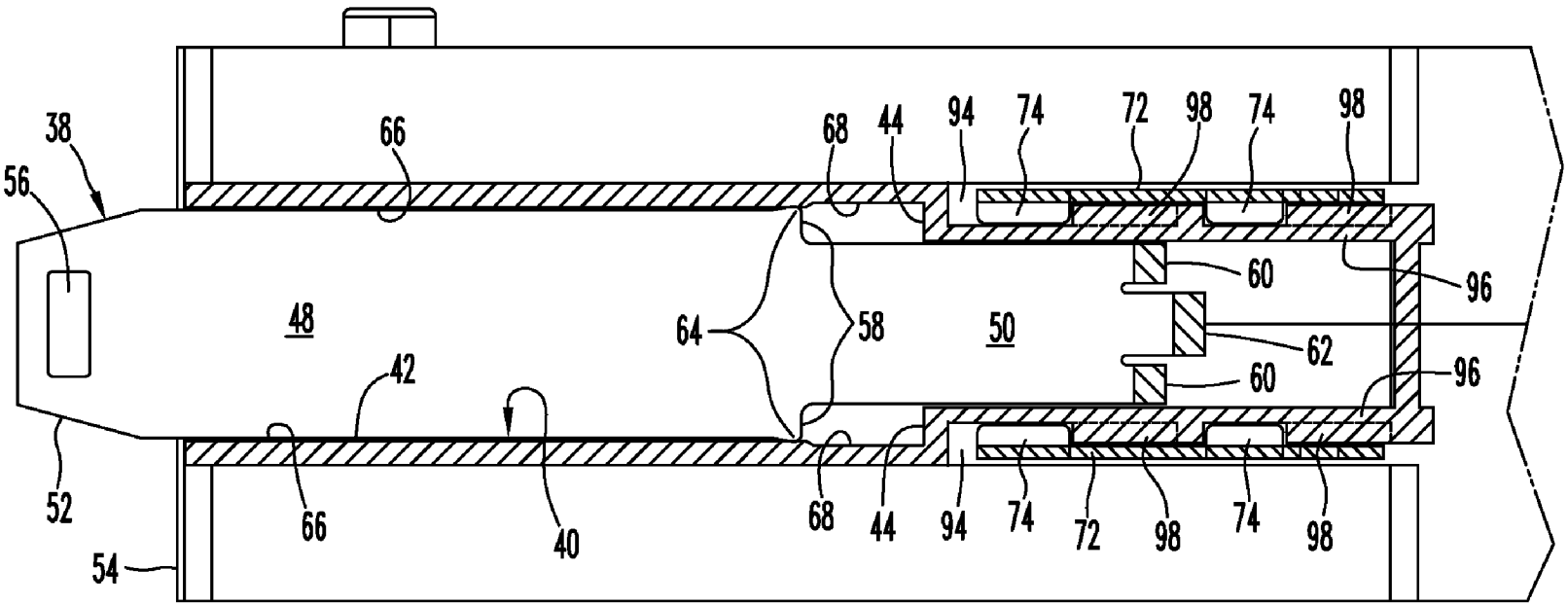
FIG. 6 is a sectional view similar to FIG. 3 showing the release member in a retracted loading position in the shells forming the base.

Wide groove portion 42 has opposed, parallel walls 66 extending from base end 54 inwardly to a short distance before steps 44. See FIG. 6. Recesses 68 in sides 66 extend from the steps 44 a distance toward base end 54 and increase the width of groove 40 adjacent the step 44 to a distance slightly greater than the width of release member 38 at projections 64. The width of wide strip portion 48 away from projections 64 has a close, sliding fit in wide groove portion 42 between sides 66 as illustrated in FIG. 6. Narrow portion 50 has a close, sliding fit in groove portion 46. During assembly of base 10, release member 38 is held in place in stepped groove 40 in an assembly position. Shoulders 58 are spaced away from steps 44. Projections 64 frictionally engage sides 66 adjacent groove recesses 68 to hold member 38 in the assembly position, as shown in FIG. 6 and described below.

Figure 7:
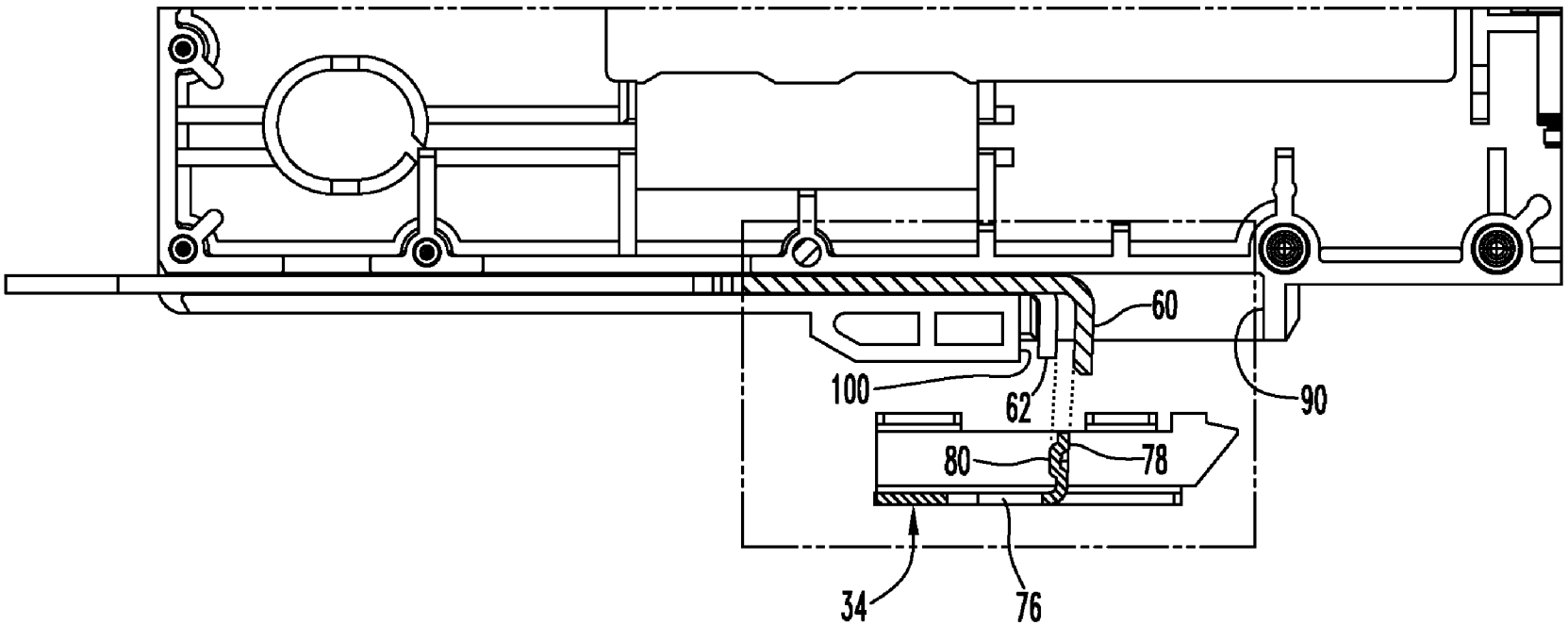
FIG. 7 is a sectional view showing mounting of the DIN rail latch member on the release member in the position shown in FIG. 6.
Figure 8:
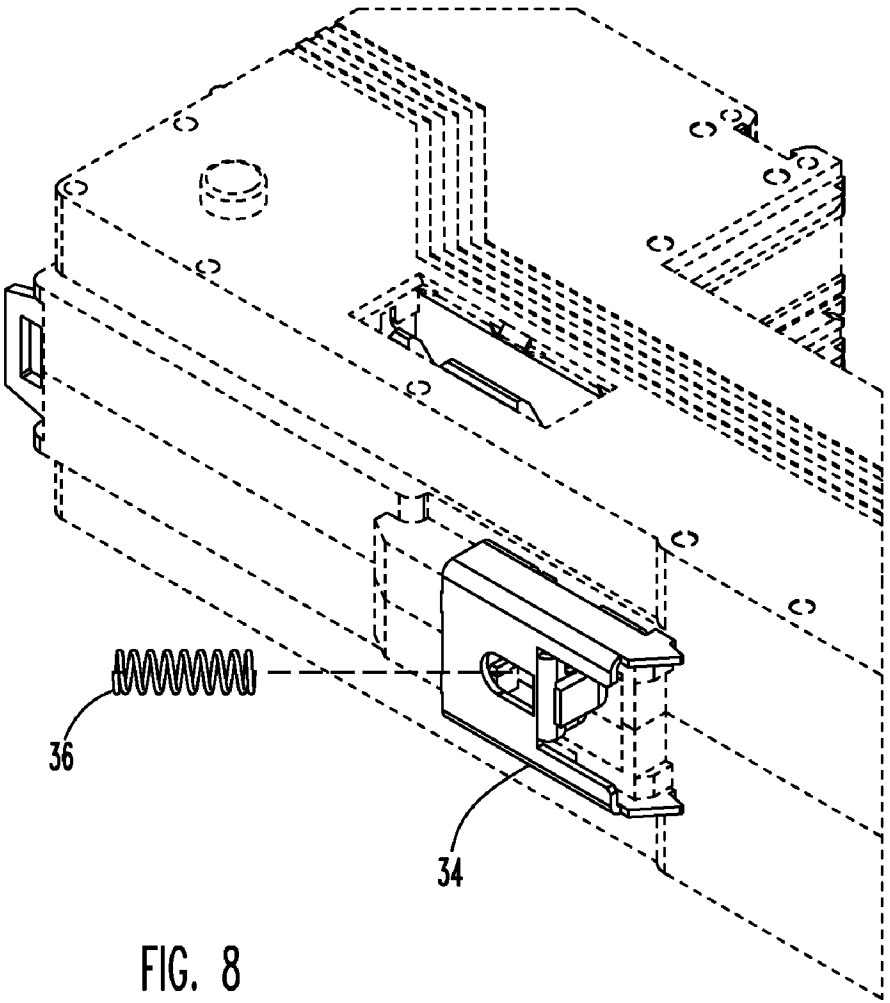
FIG. 8 is a perspective view illustrating insertion of a return spring into the latch member mounted on the release member.
Figure 10:
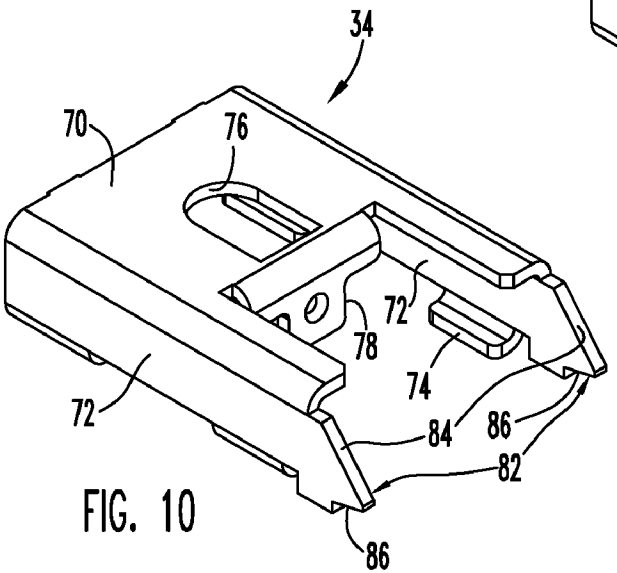
FIGS. 10 and 11 are perspective views of the top and bottom of the DIN latch member.
Figure 11:
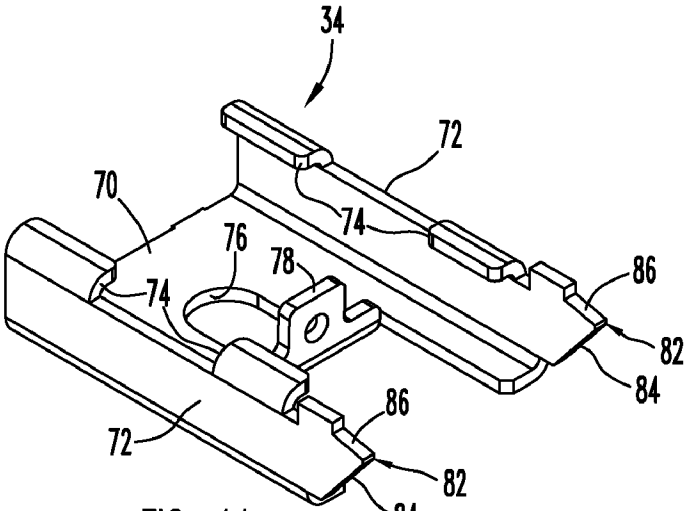

Latch member 34 is shown in FIGS. 10 and 11. The member 34 has a flat base 70, 90-degree side walls 72 which extend up from the base from opposed base sides, and inwardly bent retention arms 74 extending over the base from the tops of the side walls. Spring access opening 76 is formed through the center of base 70. Attachment arm 78 extends upwardly from base 70 inwardly of opening 76 and includes a small outwardly facing spring alignment dimple 80 as shown in FIG. 7. Latches 82 are formed on the lead ends of side walls 72 and each include an angled lead-in or cam surface 84 and a retention notch 86.

Assembly of the DIN rail latch assembly 16 on body 18 will now be described. Electronic components are mounted in shell body 18 at the same time the latch assembly is mounted in the body. Mounting of the components in body 18 is not described.

The latch assembly 16 is mounted in shell body 18 by first positioning release member 38 in the part of groove 40 in one of the open shells 20, 22 in an assembly position with outer end 52 extending a distance outwardly from the end 54 of the shell greater than when in the normal operative position of end 52. The projection 64 engages the side 66 of the groove in the position shown in FIG. 6 and does not extend into the adjacent groove recess 68. The mounting fingers 60 and 62 are likewise a distance outwardly from their normal operating range of movement in base 10. FIG. 6 shows the release member 38 in the assembly position.

Figure 5:
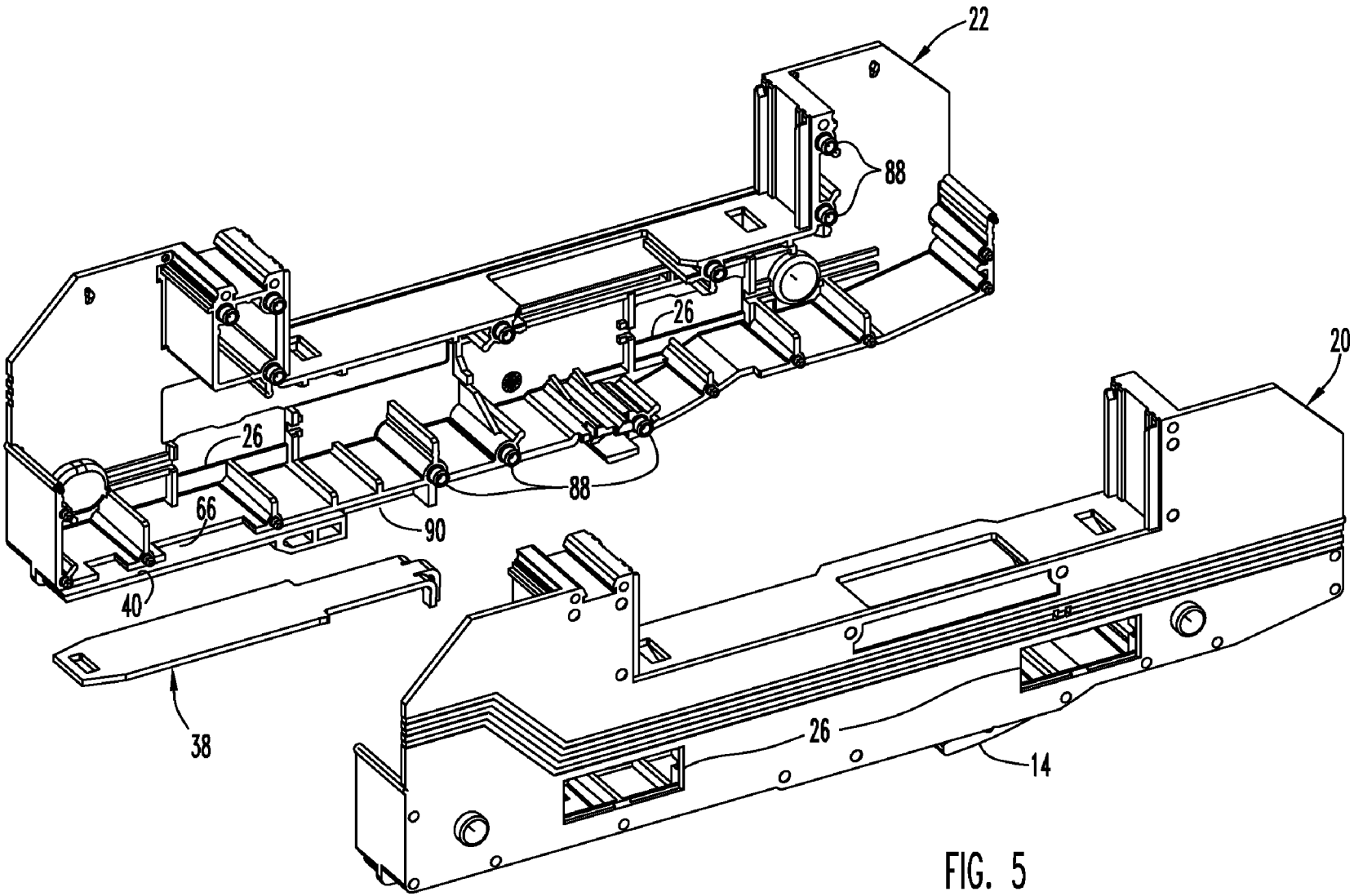
FIG. 5 is an exploded view of a base illustrating the position of a release member for assembly in the base.

With the release member in the assembly position in one shell 20, 22, the second shell 22, 20 is positioned over the shell 20, 22 in which the release member is positioned and the two shells are moved together to lock the shells together by engagement of post and recess fasteners mounted on the interfaces of the shells. Posts 88 are shown on the interface of shell 22 illustrated in FIG. 5. Complementary recesses are provided on the interface of shell 20. With the shells 20 and 22 secured together, release member is held in the stepped groove 40 in the assembly position shown in FIG. 6 with projections 64 engaging the sides 66 of wide groove portion 42 to prevent movement of the release member along groove 40. Narrow portion 50 of release member 38 extends into groove portion 46 and the fingers 60 and 62 extend downwardly into latch window 90 located at the inner end of the release member as shown in FIGS. 6 and 7.

Next, latch member 34 is positioned below window 90 and is moved upwardly to extend mounting arm 78 between fingers 60 and 62 in window 90 and move the retention arms 74 against the bottom surfaces 94 of shells 20 and 22, to either side of the walls 96 forming the sides of narrow groove portion 46. Dimple 80 extends between fingers 60 and is in position to locate spring 36 in member 34.

Latch member arms 74 rest against shell bottom surfaces 94 at assembly. The sidewalls 72 of the latch member are located on the outer sides of walls 96. The two arms 74 nearest the latches are guided during assembly by channels between retention projections 98 extending outwardly from walls 96. The two arms 74 positioned away from latches 82 are similarly guided during assembly by channels between retention projections 98 and the outer walls of groove steps 44. See FIG. 6.

Next, the outer end 52 of release member 38 is pushed into body 18 to move projections 64 out of interference engagement with groove sides 66 and into recesses 68. At the same time, the latch member 34 is pushed inwardly and the arms 74 are moved under overhanging features in retention projections 98 to secure the latch member on body 18.

With the latch member 34 and release member 38 positioned inwardly, spring 36 is compressed and moved through access opening 76 in latch member base 70 and released. One end of the spring fits over dimple 80 on latch member arm 78. The other end of the spring engages wall 100 at the outer side of latch window 90. With release member projections 64 movable freely in recesses 68, the joined release member 38 and latch member 34 are in the operative position and are movable toward and away from the DIN rail. Spring 36 normally holds the members in the inner, latched position shown in FIG. 4. Outward movement of release member end 52, typically by inserting a tool in opening 56 and moving the tool away from base end 54, moves the members 38 and 34 to a retracted, unlatched position with spring 36 compressed between arm 78 and wall 100. During movement of the latch member 34 between the latched and unlatched positions, the outer arms 74 remain under projections 98 to retain the latch member on the bottom of body 18.

The assembled power supply base 10 is mounted on DIN rail by lowering rail hook 14 below one DIN rail flange 32 and then moving the hook 14 under the flange with the base angled upwardly above the rail. The base is then rotated down so that the other flange 32 engages angled lead-in or cam surfaces 84 on latch member 34. Downward rotation cams the latch member and release member outwardly until the flange 32 moves past lead-in surfaces and compressed spring 36 returns the members 34 and 38 inwardly to the latched position shown in FIG. 1. In this position, the adjacent DIN rail flange 32 is seated in retention notches 86 and base 10 is mounted on rail 12.

The base is removed from the rail by gripping the outer end 52 of release member 38 and moving the end outwardly to retract latch member 34 from engagement with the adjacent DIN rail flange 32. The base assembly is then rotated up around the recess under hook 14 and freed from rail 12.

What we claim as our invention is:

1. A base for mounting on a DIN rail, the base comprising a body and a latch assembly; the body including an interior cavity for an electronic component, a surface extending between a DIN rail location and an actuation location, a retention member adjacent the DIN rail location, a first wall extending along said surface, and a first recess in said first wall; said latch assembly including a release member on the surface and extending along the wall, an actuator at said actuation location, a first attachment member adjacent the DIN rail location, and a first projection on a side of the release member adjacent the wall; and a latch member adjacent the DIN rail location, the latch member including a second attachment member engageable with said first attachment member to mount the latch member on the release member, and a latch engageable with a DIN rail; the release member having an assembly position away from the DIN rail location with said projection physically engaging the wall adjacent the recess to prevent movement of the release member along the surface and permit mounting of the latch member on the release member by engagement between said first and second attachment members; said latch assembly having an operative position where the release member is closer to the DIN rail location than when in the assembly position, the first projection is in said first recess, a portion of the latch member engages the retention member to secure the latch member on the base, and the latch assembly is movable toward and away from the DIN rail location to engage and disengage a DIN rail.

2. The base as in claim 1 including a spring biasing the latch assembly toward the DIN rail location.

3. The base as in claim 2 wherein said surface is flat and the release member includes a flat strip movable along said surface.

4. The base as in claim 3 wherein said first wall and said first recess are on one side of the surface and including a second wall and a second recess on an opposite side of said surface, the release member including a second projection adjacent said second side, said second projection engaging said second side when the release member is in the assembly position and said second projection in said second recess when the latch assembly is in the operative position.

5. The base as in claim 4 wherein said first attachment member comprises a plurality of fingers and said second attachment member comprises an arm, said arm extending between said fingers when the latch assembly is in the operative position.

6. The base as in claim 3 wherein the width of the strip adjacent the actuation location is greater than the width of the strip adjacent the DIN rail location.

7. The base as in claim 6 wherein the release member includes an inward step adjacent said projection.

8. The base as in claim 3 wherein said retention member comprises a retention projection on the base and the latch member includes an arm engageable with the retention member when the latch assembly is in the operative position.

9. The base as in claim 3 wherein the base includes a DIN rail hook at the DIN rail location, said latch member and DIN rail hook engageable with flanges on opposite sides of a DIN rail to mount the base on the rail.

10. The combination of a power supply base as in claim 1 and a power conditioning module in said cavity.

11. The base as in claim 3 including a locked connection between the release member and the latch member when the latch assembly is in the operative position.

12. The base as in claim 11 wherein said locked connection includes a first angled member on the release member, a second angled member on the latch member positioned outwardly from and overlying the first angled member so that outward movement of the release member locks such members together for movement of the latch member away from the DIN rail location.

13. The base as in claim 12 wherein said first angled member extends at slightly less than 90 degrees from the release member.

14. A base for latch mounting on a support, the base comprising a body and a latch assembly; the body including a surface extending between a support location and an actuation location, a first wall extending along said surface, and a first recess in said first wall; said latch assembly including a release member on the surface and extending along said wall, an actuator at said actuation location, a first attachment member adjacent the support location, and a first projection on a side of the release member adjacent the wall, and a latch member adjacent the support location, the latch member including a second attachment member engageable with said first attachment member to mount the latch member on the release member, and a latch engageable with the support; the release member having an assembly position away from the support location with said projection physically engaging the wall adjacent the recess to prevent movement of the release member along the surface and permit mounting of the latch member on the release member by engagement between said first and second attachment members; said latch assembly having an operative position where the release member is closer to the support location than when in the assembly position, the first projection is in said first recess, a portion of the latch member engages the retention member to secure the latch member on the base, and the latch assembly is movable toward and away from the support location to engage and disengage the support.

15. The base as in claim 14 including a spring biasing the latch assembly toward the support location.

16. The base as in claim 15 wherein said surface is flat and the release member includes a flat strip movable along said surface.

17. The base as in claim 16 wherein said first wall and said first recess are on one side of the surface and including a second wall and a second recess on an opposite side of said surface, the release member including a second projection adjacent said second side, said second projection engaging said second side when the release member is in the assembly position and said second projection in said second recess when the latch assembly is in the operative position.

18. The base as in claim 17 wherein the width of the strip at the actuation location is greater than the width of the strip adjacent the support location and the release member includes an inward step adjacent said projections.

19. The base as in claim 18 including a locked connection between the release member and the latch member when the latch assembly is in the operative position, comprising a first angled member on the release member, a second angled member on the latch member positioned outwardly from and overlying the first angled member so that outward movement of the release member locks such members for movement of the latch member away from the support location.

* * * * *